US011800940B2

(12) United States Patent
Krishnamoorthy et al.

(10) Patent No.: US 11,800,940 B2
(45) Date of Patent: *Oct. 31, 2023

(54) SYSTEMS AND METHODS FOR REDUCING CONDENSATION IN REFRIGERATED CASES

(71) Applicant: Hill Phoenix, Inc., Conyers, GA (US)

(72) Inventors: Naresh Kumar Krishnamoorthy, Kerala (IN); Shobin Balakrishnan, Karnataka (IN)

(73) Assignee: Hill Phoenix, Inc., Conyers, GA (US)

( * ) Notice: Subject to any disclaimer, the term of this patent is extended or adjusted under 35 U.S.C. 154(b) by 116 days.

This patent is subject to a terminal disclaimer.

(21) Appl. No.: 17/479,917

(22) Filed: Sep. 20, 2021

(65) Prior Publication Data

US 2022/0071412 A1 Mar. 10, 2022

Related U.S. Application Data

(63) Continuation of application No. 16/668,240, filed on Oct. 30, 2019, now Pat. No. 11,160,393.

(51) Int. Cl.

| | |
|---|---|
| ***F25D 21/04*** | (2006.01) |
| ***A47F 3/04*** | (2006.01) |
| ***A47F 3/00*** | (2006.01) |
| ***F25D 29/00*** | (2006.01) |

(52) U.S. Cl.

CPC ..... *A47F 3/0478* (2013.01); *A47F 3/001* (2013.01); *F25D 21/04* (2013.01); *F25D 29/005* (2013.01); *F25B 2400/22* (2013.01); *F25D 2321/14* (2013.01); *F25D 2400/02* (2013.01); *F25D 2700/12* (2013.01)

(58) Field of Classification Search

CPC .. F25B 2400/22; F25D 21/04; F25D 2321/14; A47F 3/0478

See application file for complete search history.

(56) References Cited

U.S. PATENT DOCUMENTS

| | | | | |
|---|---|---|---|---|
| 6,973,794 | B2 | 12/2005 | Street et al. | |
| 6,999,996 | B2 | 2/2006 | Sunderland | |
| 7,340,907 | B2 | 3/2008 | Vogh | |
| 9,751,498 | B2 * | 9/2017 | Lisinski | H05B 1/0236 |
| 10,041,713 | B1 * | 8/2018 | Zugibe | F24F 11/62 |
| 10,871,001 | B2 * | 12/2020 | Stiles, Jr. | F04B 49/20 |
| 10,947,981 | B2 * | 3/2021 | Stiles | F04D 15/0066 |
| 11,160,393 | B2 | 11/2021 | Kirshnamoorthy et al. | |
| 11,432,377 | B2 * | 8/2022 | Patel | H05B 3/845 |

(Continued)

*Primary Examiner* — Filip Zec

(74) *Attorney, Agent, or Firm* — Fish & Richardson P.C.

(57) ABSTRACT

A method for reducing sweating in a temperature-controlled display device includes receiving values of an ambient temperature, a door frame temperature, and relative humidity. The method can also include estimating a value of a dewpoint temperature using the values of the ambient temperature and the relative humidity. The method can also include determining control decisions for a door frame heater of the temperature-controlled display device using the value of the dewpoint temperature and the door frame temperature, and transitioning the door frame heater between an on-state and an off-state using the control decisions to maintain the value of the door frame temperature at or above the value of the dewpoint temperature.

24 Claims, 10 Drawing Sheets

(56) References Cited

U.S. PATENT DOCUMENTS

| | | | | |
|---|---|---|---|---|
| 2014/0260360 | A1* | 9/2014 | Rasch | A47F 3/0478 62/80 |
| 2015/0060431 | A1* | 3/2015 | Yang | H05B 3/845 62/3.2 |
| 2015/0335175 | A1* | 11/2015 | Choueifati | A47F 3/0408 62/89 |
| 2017/0238730 | A1* | 8/2017 | Schalich | A47G 1/02 |
| 2021/0127854 | A1 | 5/2021 | Krishnamoorthy et al. | |

* cited by examiner

SYSTEMS AND METHODS FOR REDUCING CONDENSATION IN REFRIGERATED CASES

CROSS-REFERENCE TO RELATED APPLICATION

This application is a continuation application of, and claims priority under 35 U.S.C. § 120 to, U.S. patent application Ser. No. 16/668,240, filed on Oct. 30, 2019, the entire contents of which is incorporated herein by reference.

BACKGROUND

Typically, a refrigerated display case has several doors which provide access to products located on shelves in a single refrigerated zone. While products may be separated on shelves according to which door they are proximate to, they may be similarly cooled within the refrigerated zone. When the doors are opened, ambient (e.g., humid) air may enter the refrigerated display case and cooled air from the refrigerated display case may exit the refrigerated display case. The moisture in the humid air may condense and collect on various windows of the refrigerated display case.

SUMMARY

One implementation of the present disclosure is a temperature-controlled display device, according to an exemplary embodiment. The temperature-controlled display device can include multiple walls, a door frame, a door frame heater, a door frame temperature sensor, a humidity sensor, an ambient temperature sensor, and a controller. The door frame heater is configured to provide heating to the door frame. The door frame temperature sensor is configured to measure a door frame temperature. The humidity sensor is configured to measure relative humidity of an environment surrounding the temperature-controlled display device. The ambient temperature sensor is configured to measure ambient temperature of the environment surrounding the temperature-controlled display device. The controller includes processing circuitry configured to receive values of the door frame temperature, the relative humidity of the environment, and the ambient temperature of the environment. The processing circuitry is also configured to calculate a value of a dewpoint temperature using the values of the relative humidity of the environment, and the ambient temperature of the environment. The processing circuitry is also configured to perform hysteresis control to generate control decisions using a first temperature threshold value, a second temperature threshold value, and the value of the temperature at the door frame, and operate the door frame heater based on the control decisions to maintain the value of the door frame temperature at or above the value of the dewpoint temperature.

In some embodiments, the door frame temperature sensor is configured to measure or obtain the value of the door frame temperature at a coldest location of the door frame.

In some embodiments, the processing circuitry is configured to determine the first temperature threshold value by adding a first quantity to the value of the dewpoint temperature, and determine the second temperature threshold value by adding a second quantity to the value of the dewpoint temperature.

In some embodiments, the first quantity is less than the second quantity.

In some embodiments, the first temperature threshold value and the second temperature threshold value are greater than the value of the dewpoint temperature.

In some embodiments, the processing circuitry is configured to transition the door frame heater between an on-state or a heating state, and an off-state or a standby state in response to the value of the door frame temperature exceeding one of the first temperature threshold value and the second temperature threshold value.

In some embodiments, the processing circuitry is configured to operate the door frame heater to maintain the value of the door frame temperature at or above the value of the dewpoint temperature to reduce sweating in the temperature-controlled display device.

Another implementation of the present disclosure is a temperature-controlled display device, according to an exemplary embodiment. The temperature-controlled display device includes multiple walls, a door frame, a door frame heater, a door frame temperature sensor, a humidity sensor, an ambient temperature sensor, and a controller. The door frame heater is configured to provide heating to the door frame. The door frame temperature sensor is configured to measure a temperature at the door frame. The humidity sensor is configured to measure relative humidity of an environment surrounding the temperature-controlled display device. The ambient temperature sensor is configured to measure ambient temperature of the environment surrounding the temperature-controlled display device. The controller includes processing circuitry configured to receive values of the temperature at the door frame, the relative humidity of the environment, and the ambient temperature of the environment. The processing circuitry is configured to calculate a value of a dewpoint using the values of the relative humidity of the environment, and the ambient temperature of the environment. The processing circuitry is configured to perform PID control to generate control decisions using a value of a setpoint temperature and the value of the temperature at the door frame and operate the door frame heater based on the control decisions to maintain the value of the door frame temperature at or above the value of the setpoint temperature.

In some embodiments, the door frame temperature sensor is configured to measure or obtain the value of the door frame temperature at a coldest location of the door frame.

In some embodiments, the processing circuitry is configured to determine the value of the setpoint temperature by adding a predetermined temperature quantity to the value of the dewpoint temperature.

In some embodiments, the value of the setpoint temperature is a dynamic value that is adjusted in response to changes in the value of the temperature at the door frame or changes in the value of the relative humidity of the environment.

In some embodiments, the processing circuitry is configured to perform PID control to determine a percent of time that the heater should be in an on-state to maintain the value of the door frame temperature at or above the value of the setpoint temperature.

In some embodiments, the processing circuitry is configured to generate a duty cycle signal based on the control decisions generated by performing the PID control and provide the duty cycle signal to the door frame heater to maintain the value of the door frame temperature at or above the value of the dewpoint temperature.

Another implementation of the present disclosure is a method for reducing sweating in a temperature-controlled display device, according to an exemplary embodiment. The method can include receiving values of an ambient temperature, a door frame temperature, and relative humidity. The method can also include estimating a value of a dewpoint temperature using the values of the ambient temperature and the relative humidity. The method can also include determining control decisions for a door frame heater of the temperature-controlled display device using the value of the dewpoint temperature and the door frame temperature, and transitioning the door frame heater between an on-state and an off-state using the control decisions to maintain the value of the door frame temperature at or above the value of the dewpoint temperature.

In some embodiments, the control decisions are determined using hysteresis control. The hysteresis control may include determining a first temperature threshold value by adding a first quantity to the value of the dewpoint temperature. The hysteresis control can also include determining a second temperature threshold value by adding a second quantity to the value of the dewpoint temperature. The hysteresis control can also include determining whether the door frame heater should transition between the on-state and the off-state as the control decisions in response to the value of the door frame temperature increasing above or decreasing below one of the first temperature threshold value and the second temperature threshold value.

In some embodiments, the first temperature threshold value is less than the second temperature threshold value.

In some embodiments, the control decisions are determined using PID control. The PID control may include determining a value of a temperature setpoint by adding a predetermined temperature quantity to the value of the dewpoint temperature. The PID control can also include using the value of the temperature setpoint, and the value of the dewpoint temperature in PID control to generate a percent on or off time as the control decisions. The PID control can also include generating a duty cycle signal based on the percent on or off time and providing the duty cycle signal to the door frame heater to maintain the value of the door frame temperature at the value of the temperature setpoint.

In some embodiments, the value of the setpoint temperature is a dynamic value that is adjusted in response to changes in the value of the temperature at the door frame or changes in the value of the relative humidity of the environment.

In some embodiments, the value of the door frame temperature is obtained from a door frame temperature sensor that is positioned along a door frame of the temperature-controlled display device at a coldest location of the door frame.

In some embodiments, the door frame heater is operable to provide heating to the door frame.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

DETAILED DESCRIPTION

Overview

Referring generally to the FIGURES, a temperature-controlled display device includes multiple walls, a door frame, one or more doors, a cooling system, a door frame heater, and a variety of sensors. The walls can define an inner volume which is cooled by the cooling system. The door frame heater can be configured to provide heating to the door frame to maintain a temperature of the door frame at or above a dewpoint. The controller is configured to receive an ambient temperature of the environment surrounding the temperature-controlled display device, the door frame temperature, and a relative humidity from the sensors. A temperature sensor can be positioned at a coldest location along the door frame. The controller can use hysteresis control or PID control to generate control decisions and control signals for the door frame heater to maintain the door frame temperature at or above the dewpoint temperature. The controller may calculate the dewpoint temperature using the relative humidity and the ambient temperature. The dewpoint temperature can be a dynamic value that is re-calculated by the controller in real-time using the relative humidity and the ambient temperature.

Temperature Controlled Display Case

Referring now to FIGS. 1-4, a temperature-controlled display device 10 is shown, according to an exemplary embodiment. The temperature controlled-display device 10, also referred to as a temperature controlled case, may be a refrigerator, a freezer, a refrigerated merchandiser, a refrigerated display case, or other device capable of use in a commercial, institutional, or residential setting for storing and/or displaying refrigerated or frozen objects. For example, the temperature-controlled display device 10 may be a service type refrigerated display case for displaying fresh food products (e.g., beef, pork, poultry, fish, etc.) in a supermarket or other commercial setting.

Figure 1:
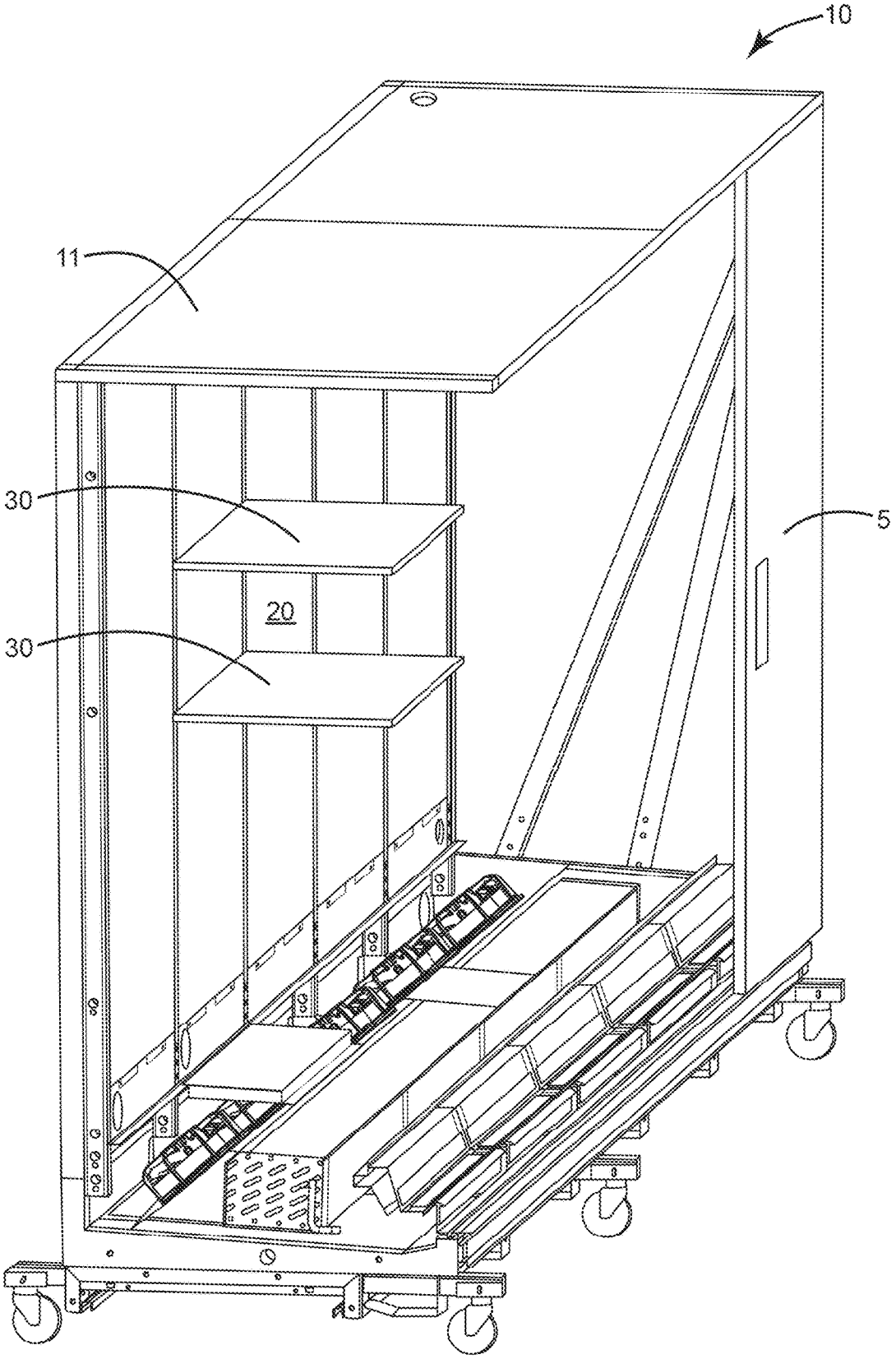
FIG. 1 is a top perspective view of a temperature-controlled case with an induced air cooling system, according to an exemplary embodiment.
Figure 2:
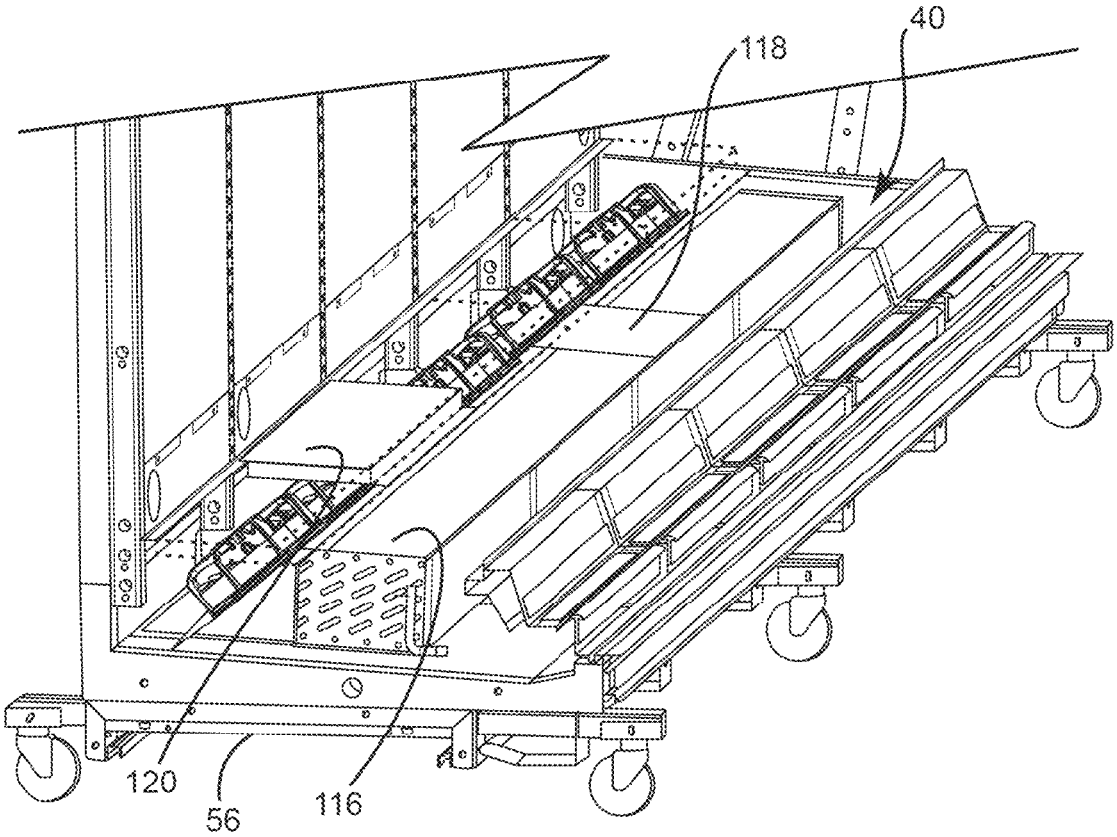
FIG. 2 is close-up perspective view of the induced air cooling system of the temperature-controlled case of FIG. 1, according to an exemplary embodiment.

The temperature-controlled display device 10 is shown to include a temperature-controlled space 20 (i.e., a display area) having a plurality of shelves 30 for storage and display of products therein. In various embodiments, the temperature-controlled display device 10 may be an open-front refrigerated display case (as shown in FIGS. 1-4) or a closed-front display case. An open-front display case may use a flow of chilled air that is discharged across the open front of the case (e.g., forming an air curtain 18) to help maintain a desired temperature within temperature-controlled space 20. A closed-front display case may include one or more doors (such as door 5 shown in FIG. 1) for accessing food products or other items stored within temperature-controlled space 20. The one or more doors may be movable from a closed position to an open position. In the closed position, the door covers or substantially covers an opening of the temperature-controlled display device 10 to prevent user access to the temperature-controlled space 20. In the open or partial open position, the door is positioned a distance away from the opening to provide user access to the space 20 via the opening. In this regard, the temperature-controlled temperature-controlled display device 10 of FIG. 1 shows only one door 5 for clarity to show the inner components of the temperature-controlled display device 10. It should be understood that both types of display cases may also include various openings within temperature-controlled space 20 that are configured to route chilled air from a cooling element 110 to other portions of the respective display case (e.g., via fan 156).

Figure 3:
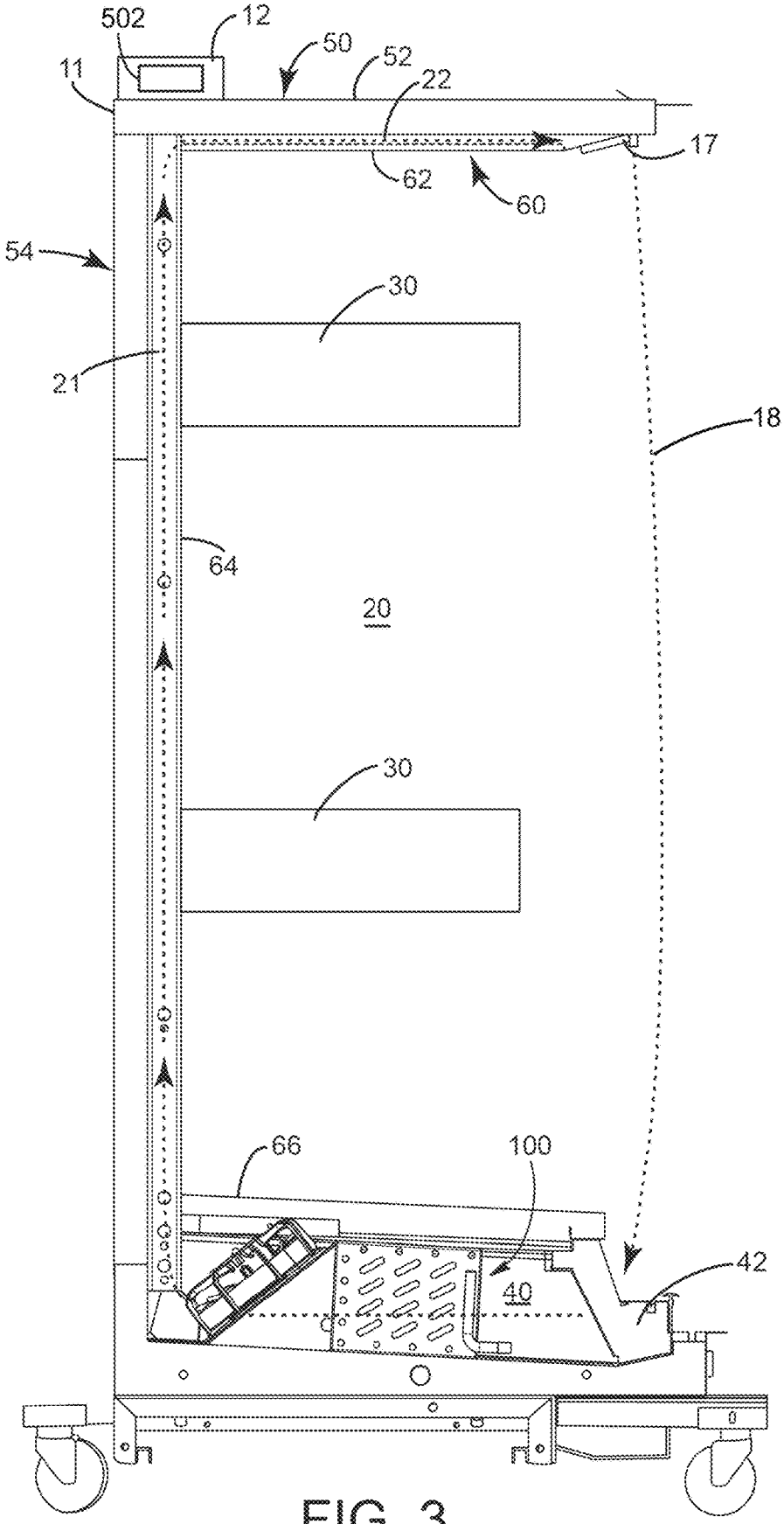
FIG. 3 is side plan view of the temperature-controlled case of FIGS. 1-2, according to an exemplary embodiment.
Figure 4:
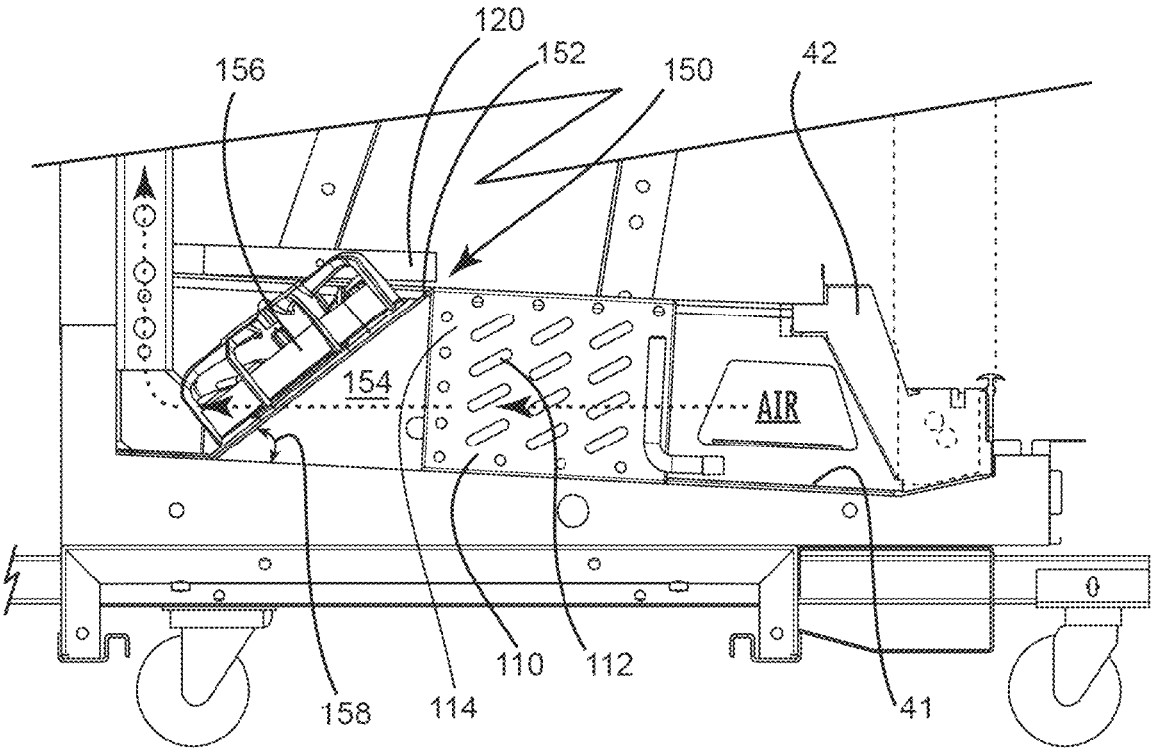
FIG. 4 is a close-up view of the induced air cooling system of FIGS. 1-3, according to an exemplary embodiment.

The temperature-controlled display device 10 may include a cooling system 100 for cooling temperature-controlled space 20 (see FIGS. 3-4). The cooling system 100 may be configured as a direct expansion system or a secondary coolant exchange system. All such variations are intended to fall within the spirit and scope of the present disclosure. The cooling system 100 includes at least one cooling element 110 that includes heat exchange fins 114 coupled to a cooling coil 112 (e.g., an evaporator coil, etc.) to form a fin-coil or fan-coil unit. In the cooling mode of operation, the cooling element 110 may operate at a temperature lower than 32 degrees Fahrenheit to provide cooling to the temperature-controlled space 20. As the heat is removed from the air circulating the space 20, the air is chilled. The chilled air may then be directed to temperature-controlled space 20 by at least one fan 156 (or another air flow or air moving device) in order to lower or otherwise control the temperature of temperature-controlled space 20.

The temperature-controlled display device 10 is shown to further include a compartment 40 located beneath the temperature-controlled space 20. In various embodiments, the compartment 40 may be located beneath the temperature-controlled space 20 (as shown), behind the temperature-controlled space 20, above the temperature-controlled space 20, or otherwise located with respect to the temperature-controlled space 20. All such variations are intended to fall within the spirit and scope of the present disclosure. The compartment 40 may contain components of the cooling system 100, such as a condensing unit. In some embodiments, the cooling system 100 includes one or more additional components such as a separate compressor, an expansion device such as a valve or other pressure-regulating device, a temperature sensor, a controller, a fan, and/or other components commonly used in refrigeration systems, any of which may be stored within compartment 40.

As shown, the temperature controlled display device 10 may also include a box 12 for electronics (i.e., an electronics box). The electronics box 12 may be structured as a junction box for one or more electrically-driven components of the device 10 (e.g., fan 156). The electronics box 12 may also be structured to store one or more controllers for one or more components of the device 10. For example, the box 12 may include hardware and/or logic components for selectively activating the cooling system 100 to achieve or substantially achieve a desired temperature in the display area 20.

As also shown, the temperature-controlled display device 10 includes a housing 11. The housing 11 includes cabinets (e.g., shells, etc.) shown as an outer cabinet 50 and an inner cabinet 60 that include one or more walls (e.g., panel, partition, barrier, etc.). The outer cabinet 50 includes a top wall 52 coupled to a rear wall 54 that is coupled to a lower base wall 56. The inner cabinet 60 includes a top wall 62 coupled to a rear wall 64 that is coupled to a base wall 66. Coupling between the walls may be via any type of attachment mechanism including, but not limited to, fasteners (e.g., screws, nails, etc.), brazes, welds, press fits, snap engagements, etc. In some embodiments, the inner and outer cabinets 60 and 50 may each be of an integral or uniform construction (e.g., molded pieces). In still further embodiments, more walls, partitions, dividers, and the like may be included with at least one of the inner and outer cabinets 60 and 50. All such construction variations are intended to fall within the spirit and scope of the present disclosure.

The temperature controlled display device 10 may define one or more ducts (e.g., channels, pipes, conduits, etc.) for circulating chilled air from the cooling system 100. As shown, the outer rear wall 54 and inner rear wall define or form a rear duct 21. The rear duct 21 is in fluid communication with the compartment 40. The rear duct 21 is also in fluid communication with a top duct 22. The top duct 22 is defined or formed by the outer top wall 52 and the inner top wall 62. While shown as primarily rectangular in shape, it should be understood that any shape and size of the ducts may be used with the temperature controlled display device 10 of the present disclosure. Furthermore, in some embodiments, at least one of the rear and top ducts 21, 22 may include one or more openings (e.g., apertures) in communication with the display area 20. When chilled air is circulated through the ducts, a portion of the chilled air may leak out of the openings into the display area 20 for additional cooling.

Operation of the ducts 21 and 22 in connection with the cooling system 100 of the temperature-controlled display device 10 may be described as follows. As heat is removed from the surrounding air via the cooling element 110, the surrounding air is chilled. While the chilled air may be directed to temperature controlled space 20 by at least one air mover or another air flow device, the chilled air may also be circulated through the ducts 21 and 22 by the fan 156. Via the motive force from the fan 156, the chilled air is first directed to the rear duct 21. The rear duct 21 guides the chilled air to the top duct 22. The top duct 22 guides the chilled air to the discharger 17 (e.g., diffuser, etc.) that discharges the chilled air to form or at least partially form the air curtain 18. At least part of the air in the air curtain 18 is received by a receptacle, shown as a vent 42 that is in fluid communication with the compartment 40. The received air may then be pulled through the cooling element by the fan 156 and the process repeated.

According to the present disclosure, the cooling system 100 includes a modular plenum 150 (e.g., modular plenum segment, modular plenum panel, etc.) coupled to the housing 11 (e.g., an inner base wall 41 of the compartment 40 proximate the outer base wall 56). As shown, the modular plenum 150 is in fluid communication with the cooling element 110 and is positioned behind or in the rear of the cooling element 110 (i.e., proximate the rear wall 64).

The modular plenum 150 may be of unitary construction or comprise two or more components coupled together. As shown, the modular plenum 150 includes a body 152 that is positioned at an angle 158 with respect to the lower base wall 41 of the compartment 40. The angle 158 is highly configurable and may vary based on spaced constraints in the compartment 40. According to one embodiment, the angle 158 is related to the position of the rear duct 21. Particularly, the angle 158 may be selected to facilitate guidance of chilled air into the rear duct 21. Advantageously, the chilled air is then induced at a higher efficiency into the duct 21. That is to say and as compared to "pushed air configurations" where the fan is placed in front of the cooling element, the combination of positioning the fan 156 behind cooling element 110 and at an angle 158 relative to the rear duct 21 enables a relatively better guidance of the chilled air into the duct 21. As a result, Applicant has determined that a relatively greater velocity of the chilled air out of the discharger 17 may be achieved. In turn, the fan(s) 156 may be operated at a relatively lower energy consumption setting, which may reduce operation costs of the cooling system 100.

Moreover, by positioning the fan 156 at the angle 158 and therefore away from the rear 64, static pressure across the cooling element 110 may be reduced. As a result, air flow through the cooling element 110 induced by the fan 156 is relatively more uniform and constant. The steady air flow through the cooling element 110 reduces static pressure to reduce the accumulation of frost in and around the cooling element 110. As a result, the number of defrost cycles used with the cooling system 100 of the present disclosure may be reduced. Consequently, operational costs may be reduced as well as downtime caused by operation of the defrost cycles.

According to one embodiment, modular plenum 150 is positioned at the angle to define an approximate 2.00-3.00 inch gap between the blades of the fan 156 and the rear wall 64. In this case, approximate refers to +/−0.1 inches. In another embodiment, the modular plenum 150 may be positioned a different distance away from the rear wall 64 (e.g., greater than or less than 2.00-3.00 inches).

As shown, the modular plenum 150 and cooling element 110 may include one or more airflow guidance devices that define a desired flow path for the air received by the vent 42 and guided through the compartment 40 into the ducts. Particularly, the modular plenum 150 is shown to include a side panel 154. The side panel 154 may have any shape to correspond with the angle 158 defined by the body 152 relative to the base wall 41. In one embodiment, the side panel 154 is coupled to the body 152 via one or more fasteners or other joining processes (e.g., welds). In another embodiment, the side panel 154 and body 152 are of unitary construction (e.g., a one-piece component). The side panel 154 prevents or substantially prevents air pulled through the cooling element 110 from escaping or leaking out prior to being induced by the fan 156 into the rear duct 21. Similarly, the cooling element 110 is shown to include a cover 116 (e.g., shroud, panel, etc.) coupled to a top portion of the cooling element 110 (e.g., to an upper surface of the fins 114). The cover 116 is positioned above the cooling element 110 (e.g., proximate the base wall 66) to prevent or substantially prevent the air passing through the cooling element 110 from moving upwards and away from the desired flow path to the fan 156 (and, consequently the ducts 21, 22). In this regard, between the end fins 114 on the cooling element and the cover 116, induced air is substantially only allowed to travel through the cooling element 110 to the fans 156.

As also shown, a plate 120 is coupled to the rear wall 64 of the temperature-controlled display device 10. The plate 120 (e.g., shroud, cover, etc.) is positioned above the modular plenum 150 and may also be coupled to the cooling element 110 (e.g., via one or more fasteners, an interference fit, a snap engagement, etc.). The plate 120 prevents or substantially prevents induced air from the fan 156 from traveling up and away from the rear duct 21. Accordingly, the combination of the plate 120, side panel(s) 154, and cover 116 guide the induced air into the rear duct 21 to substantially prevent chilled air from escaping. According to one embodiment, one plate 120 is used to shield or cover one fan 156 held by the plenum 150. In this regard, if only one fan 156 is desired to be serviced, then only the one corresponding plate 120 needs to be removed. Because the plate 120 does not extend the length of the temperature-controlled display device 10, the relatively smaller and modular plate 120 may be easier to handle and manipulate by personnel servicing or maintaining the temperature-controlled display device 10. In another embodiment, the plate 120 may be any length desired.

The modular plenum 150, side panel(s) 154, cover 116, and plate 120 may be constructed from any suitable materials for providing structural rigidity to hold the fans 156 (i.e., the modular plenum 150) and for serving as an airflow guidance device (i.e., the side panel(s) 154, cover 116, and plate 120). In one embodiment, each of the modular plenum 150, side panel(s) 154, cover 116, and plate 120 are constructed from a metal-based material (e.g., sheet metal). In another embodiment, one or more of the modular plenum 150, side panel(s) 154, cover 116, and plate 120 are constructed from a composite-based material (e.g., plastic, etc.). In still another embodiment, one or more of the modular plenum 150, side panel(s) 154, cover 116, and plate 120 are constructed from any combination of metal-based and composite-based materials.

As shown in FIGS. 3-4, a relatively large volume is defined in the compartment 40 between the cooling element 110 and the vent 42 (as compared to a conventional cooling system with the fan placed in front of the cooling element). The relatively large volume may facilitate reception of piping (e.g., to transport coolant between a condensing unit and the cooling element) and any other components of the cooling system 100 and the temperature-controlled display device 10. Further, the relatively large volume removes impediments, such as fans, to facilitate condensation to reach a frontward positioned drain. Beneficially, such a structural arrangement facilitates efficient condensation management to maintain a relatively clean compartment 40 to, in turn, reduce the frequency of defrost cycles to remove the condensation and need for service personnel to clean the compartment 40.

Figure 5:
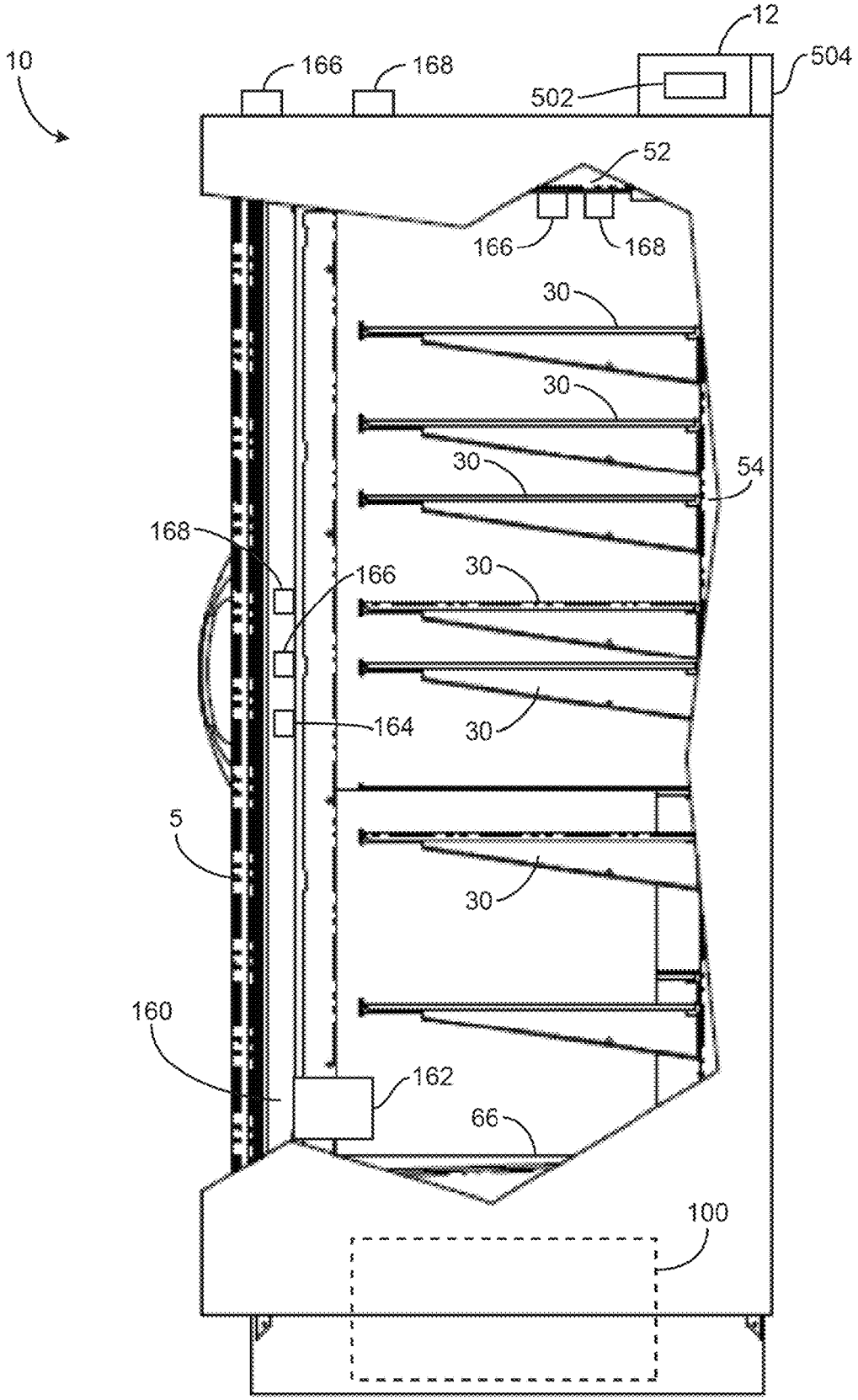
FIG. 5 is as side view of the temperature-controlled case of FIGS. 1-2, according to an exemplary embodiment.

Referring particularly to FIG. 5, the temperature-controlled display device 10 can include a controller 502, a user interface 504, a heater 162, a door frame temperature sensor 164, an ambient temperature sensor 166, and a humidity sensor 168. The heater 162 may be positioned anywhere along a door frame 160 of the temperature-controlled display device 10 and/or along one or more rails of the temperature-controlled display device 10. The door frame 160 can be a structural member of the temperature-controlled display device 10 that extends along substantially an entire height of the temperature-controlled display device 10 and seals with corresponding portions of the doors 5. For example, the door frame 160 may be a divider of the temperature-controlled display device 10 that is configured to provide heating to the door frame 160 or to an interior of the temperature-controller display device 10. The heater 162 and the cooling system 100 can be controlled or operated by the controller 502 and may operated to maintain a desired temperature and/or a desired humidity within the temperature-controlled display device 10. The heater 162 can be any heating element (e.g., a resistive heating element, a radiative heating element, a convective heating element, a conductive heating element, etc.) that is configured to provide heating to the door frame 160 and/or the interior of the temperature-controlled display device 10.

In some embodiments, the humidity sensor 168 is configured to monitor or measure humidity (e.g., relative humidity) within the temperature-controlled display device 10. The humidity sensor 168 can be positioned along the door frame 160, or may be coupled with the top wall 52, the rear wall 54, the base wall 66, etc., or otherwise positioned within the temperature-controlled display device 10. In some embodiments, the humidity sensor 168 is configured to measure humidity of areas or the environment surrounding the temperature-controlled display device 10. In some embodiments, for example, the humidity sensor 168 is positioned along an exterior surface of the upper wall 52, the outer rear wall 54, a front wall, etc. In some embodiments, the temperature-controlled display device 10 includes one or more of the humidity sensors 168 that is/are configured to measure humidity within the temperature-controlled display device 10 in addition to one or more of the humidity sensors 168 that are configured to measure the humidity of the surrounding environment of the temperature-controlled display device 10.

The ambient temperature sensor 166 can be positioned and configured to measure ambient temperature of the environment surrounding the temperature-controlled display device 10. For example, the ambient temperature sensor 166 can be positioned along any exterior or outwards facing surfaces of the temperature-controlled display device 10. In some embodiments, the ambient temperature sensor 166 is positioned along the door frame 160. In other embodiments, the ambient temperature sensor 166 is positioned on one of the doors 5.

The door frame temperature sensor 164 is positioned along the door frame 160 and is configured to measure a temperature of the door frame 160. In some embodiments, the door frame temperature sensor 164 is positioned distal from the heater 162. In some embodiments, the door frame temperature sensor 164 is positioned at a known location of the door frame 160 that regularly has the lowest temperature (e.g., the coldest portion of the door frame 160). This may ensure that the door frame temperature used in a control system (e.g., used in controller 500 as described in greater detail below) is the coldest temperature of the door frame 160. If the temperature values obtained by the door frame temperature sensor 164 are used as feedback in the control system, this may ensure that the lowest temperature is maintained at or above a dewpoint temperature (e.g., the dewpoint temperature $T_{DP}$ as described in greater detail below).

Display Device Control System

Figure 6:
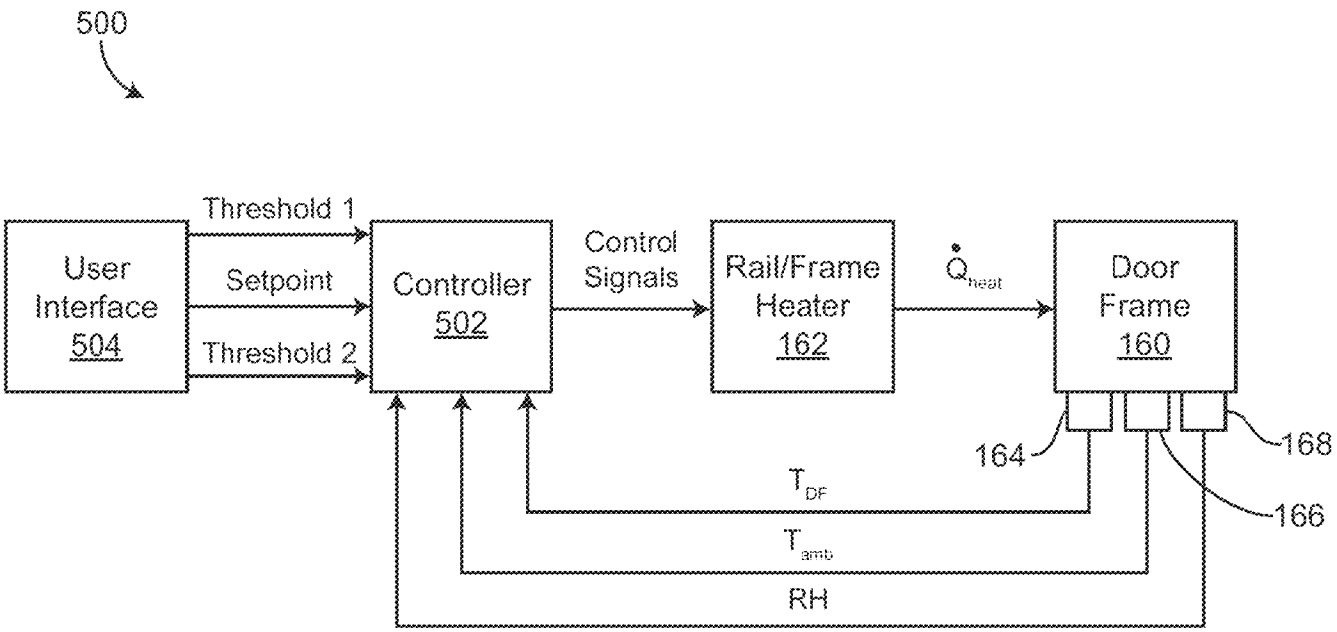
FIG. 6 is a block diagram of a control system for reducing condensation of the temperature-controlled case of FIGS. 1-2 and 5, according to an exemplary embodiment.

Referring particularly to FIG. 6, a control system 500 for the temperature-controlled display device 10 is shown, according to an exemplary embodiment. The control system 500 includes the controller 502, the heater 162, the user interface 504, the door frame temperature sensor 164, the ambient temperature sensor 166, and the humidity sensor 168. The heater 162 is configured to provide heating $\dot{Q}_{heat}$ to the door frame 160 and/or the one or more rails of the temperature-controlled display device 10. The controller 502 is configured to generate and provide control signals to the heater(s) 162 to operate the heater(s) 162 to maintain the door frame temperature $T_{DF}$ above a dewpoint temperature $T_{DP}$.

The controller 502 is configured to receive the door frame temperature $T_{DF}$ from the door frame temperature sensor 164, the ambient temperature $T_{amb}$ from the ambient temperature sensor 166, and relative humidity RH from the humidity sensor 168. The controller 500 is configured to use the door frame temperature $T_{DF}$, the ambient temperature $T_{amb}$, and the relative humidity RH to generate and provide control signals to the heater(s) 162 to maintain the door frame temperature $T_{DF}$ above the dewpoint $T_{DP}$.

The controller 502 can use a variety of control schemes to maintain the door frame temperature $T_{DF}$ above the dewpoint $T_{DP}$. Maintaining the door frame temperature $T_{DF}$ above the dewpoint $T_{DP}$ can reduce condensation or sweating that may occur in the temperature-controlled display device 10 which may occur if the door frame temperature $T_{DF}$ decreases below the dewpoint $T_{DP}$ for some amount of time. Advantageously, the control system 500 reduces the likelihood of sweating and/or condensation occurring in the temperature-controlled display device 10.

The controller 502 can also use a first temperature threshold value $T_1$, a second temperature threshold value $T_2$, and a setpoint temperature value $T_{SP}$ to generate the control signals for the heater(s) 162. In some embodiments, the first temperature threshold value $T_1$, the second temperature threshold value $T_2$ and the setpoint temperature value $T_{SP}$ are received by the controller 502 from a user interface 504. In other embodiments, only the setpoint temperature value $T_{SP}$ is received from the user interface 504. In some embodiments, any of the setpoint temperature value $T_{SP}$, the first temperature threshold value $T_1$, and the second temperature threshold value $T_2$ are stored within memory of the controller 502.

Figure 8:
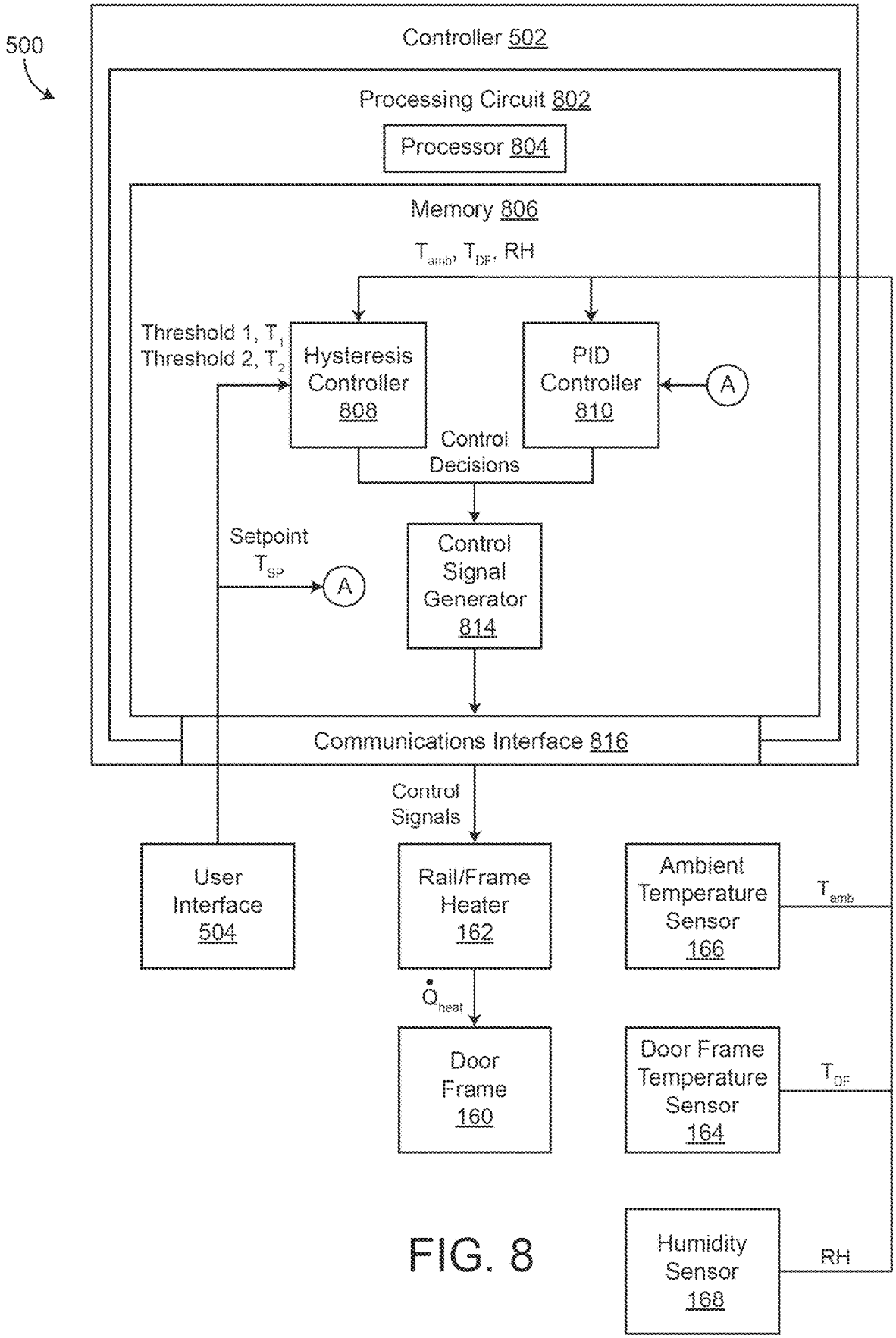
FIG. 8 is a block diagram of the control system of FIG. 6, showing a controller of the control system in greater detail, according to an exemplary embodiment.

Referring particularly to FIG. 8, the controller 502 can include a communications interface 816. The communications interface 816 may facilitate communications between the controller 502 and external systems, devices, sensors, etc. (e.g., the user interface 504, the heater(s) 162, the ambient temperature sensor 166, the door frame temperature sensor 164, the humidity sensor 168, etc.) for allowing user control, monitoring, and adjustment to any of the communicably connected devices, sensors, systems, heaters, etc. The communications interface 816 may also facilitate communications between the controller 502 and a human machine interface.

The communications interface 816 can be or include wired or wireless communications interfaces (e.g., jacks, antennas, transmitters, receivers, transceivers, wire terminals, etc.) for conducting data communications with sensors, devices, systems, etc., of the control system 500 or other external systems or devices (e.g., a user interface, one or more components, devices, sensors, etc., of the temperature-controlled display device 10, etc.). In various embodiments, communications via the communications interface 816 can be direct (e.g., local wired or wireless communications) or via a communications network (e.g., a WAN, the Internet, a cellular network, etc.). For example, the communications interface 816 can include an Ethernet card and port for sending and receiving data via an Ethernet-based communications link or network. In another example, communications interface 816 can include a Wi-Fi transceiver for communicating via a wireless communications network. In some embodiments, the communications interface is or includes a power line communications interface. In other embodiments, the communications interface is or includes an Ethernet interface, a USB interface, a serial communications interface, a parallel communications interface, etc.

The controller 202 includes a processing circuit 802, a processor 804, and memory 806, according to some embodiments. The processing circuit 802 can be communicably connected to the communications interface 816 such that the processing circuit 802 and the various components thereof can send and receive data via the communications interface. The processor 804 can be implemented as a general purpose processor, an application specific integrated circuit (ASIC), one or more field programmable gate arrays (FPGAs), a group of processing components, or other suitable electronic processing components.

The memory 806 (e.g., memory, memory unit, storage device, etc.) can include one or more devices (e.g., RAM, ROM, Flash memory, hard disk storage, etc.) for storing data and/or computer code for completing or facilitating the various processes, layers and modules described in the present application. The memory 806 can be or include volatile memory or non-volatile memory. The memory 806 can include database components, object code components, script components, or any other type of information structure for supporting the various activities and information structures described in the present application. According to some embodiments, the memory 806 is communicably connected to the processor 804 via the processing circuit 802 and includes computer code for executing (e.g., by the processing circuit 802 and/or the processor 804) one or more processes described herein.

The memory 806 is shown to include a hysteresis controller 808, a PID controller 810, and a control signal generator 814. The hysteresis controller 808 is configured to receive the ambient temperature $T_{amb}$, the door frame temperature $T_{DF}$, and the relative humidity RH from their respective sensors 164-168. The hysteresis controller 808 is also configured to receive the first threshold temperature value $T_1$, and the second threshold temperature value $T_2$ from the user interface 504. In other embodiments, the first threshold temperature value $T_1$ and the second threshold temperature value $T_2$ are stored in the memory 806. The hysteresis controller 808 is configured to perform hysteresis control using any of the received information or received values to generate control decisions for the heater(s) 162 to maintain the door frame temperature $T_{DF}$ above the dewpoint temperature $T_{DP}$.

The PID controller 810 is configured to receive the ambient temperature $T_{amb}$, the door frame temperature $T_{DF}$, and the relative humidity RH from their respective sensors 164-168. The PID controller 810 is also configured to receive the setpoint temperature $T_{SP}$ from the user interface 504 (or as stored in the memory 806). The PID controller 810 is configured to perform PID control using the received ambient temperature $T_{amb}$, the door frame temperature $T_{DF}$, the relative humidity RH, and the setpoint temperature $T_{SP}$ to generate control decisions for the heater(s) 162 so that the door frame temperature $T_{DF}$ is maintained above the dewpoint temperature $T_{DP}$.

The control signal generator 814 is configured to receive the control decisions from the hysteresis controller 808 and the PID controller 810 and use the control decisions to generate control signals for the heater(s) 162 to maintain the door frame temperature $T_{DF}$ above the dewpoint temperature $T_{DP}$. The PID control and the hysteresis control performed by the PID controller 810 and the hysteresis controller 808, respectively, is described in greater detail hereinbelow.

Hysteresis Controller

Referring still to FIG. 8, the hysteresis controller 808 is configured to receive the first temperature threshold value $T_1$, the second temperature threshold value $T_2$, the ambient temperature $T_{amb}$, the door frame temperature $T_{DF}$, and the relative humidity RH. The hysteresis controller 808 is configured to calculate the dewpoint temperature $T_{DP}$ using the relative humidity RH and the ambient temperature $T_{amb}$ in the equation:

$$T_{DP} = \left(\frac{RH}{100}\right)^{\frac{1}{8}}(112 + 0.9T_{amb}) + 0.1T_{amb} - 112$$

according to some embodiments.

In some embodiments, the hysteresis controller 808 receives the first threshold temperature value $T_1$ and the second threshold temperature value $T_2$ from the user interface 504 or from the memory 806. In other embodiments, the hysteresis controller 808 is configured to determine or calculate the first temperature threshold value using the equation:

$$T_1 = T_{DP} + \Delta T_1$$

where $T_1$ is the first temperature threshold value, $T_{DP}$ is the dewpoint temperature, and $\Delta T_1$ is a temperature quantity (e.g., 2 degrees Fahrenheit, 1 degree Fahrenheit, 3 degrees Fahrenheit, etc.).

The hysteresis controller 808 can also calculate or determine the second threshold temperature value $T_2$ using the equation:

$$T_2 = T_{DP} \Delta T_2$$

where $T_2$ is the second temperature threshold value, $T_{DP}$ is the dewpoint temperature, and $\Delta T_2$ is a temperature quantity (e.g., 5 degrees Fahrenheit, 4 degrees Fahrenheit, 6 degrees Fahrenheit, etc.).

The hysteresis controller 808 may receive the door frame temperature $T_{DF}$ from the door frame temperature sensor 164 and compare the door frame temperature $T_{DF}$ to the first temperature threshold value $T_1$ and the second temperature threshold value $T_2$. If the door frame temperature $T_{DF}$ is greater than or equal to the second temperature threshold value $T_2$ (i.e., $T_{DF} \geq T_2$), the hysteresis controller 808 can determine that the heater(s) 162 should be turned off (as the control decision). If the door frame temperature $T_{DF}$ is less than or equal to the first temperature threshold value $T_1$ (i.e., $T_{DF} \leq T_1$), the hysteresis controller 808 may determine that the heater(s) 162 should be turned on (as the control decision). For example, if the hysteresis controller 808 determines that the door frame temperature $T_{DF}$ is initially less than (or equal to) the first temperature threshold value $T_1$, the hysteresis controller 808 may determine that the heater(s) 162 should be switched on or transitioned into an on-state. The hysteresis controller 808 can provide an indication or a command to the control signal generator 814 that the heater(s) 162 should be switched on as the control decision. The hysteresis controller 808 may maintain the heater(s) 162 in the on-state and may monitor the door frame temperature $T_{DF}$. Once the door frame temperature $T_{DF}$ exceeds the second temperature threshold value $T_2$ (i.e., $T_{DF} \geq T_2$ or $T_{DF} > T_2$) the hysteresis controller 808 may determine that the heater(s) 162 should be switched off or transitioned into an off-state. The hysteresis controller 808 may maintain the heater(s) 162 in the off-state until the door frame temperature $T_{DF}$ drops below the first temperature threshold value $T_1$.

The hysteresis controller 808 may operate to maintain the door frame temperature $T_{DF}$ above the dewpoint temperature $T_{DP}$ to facilitate reducing the likelihood of condensation, moisture accumulation, and sweating of the temperature-controlled display temperature-controlled display device 10. Advantageously, this may improve visibility into the temperature-controlled display temperature-controlled display device 10.

PID Controller

Referring still to FIG. 8, the PID controller 810 may also be configured to generate control decisions for the heater(s) 162. The PID controller 810 receives the setpoint temperature $T_{SP}$, the ambient temperature $T_{amb}$, the door frame temperature $T_{DF}$, and the relative humidity RH. The PID controller 810 performs PID control to determine the control decisions for the heater(s) 162 (e.g., to determine when to transition the heater(s) 162 between the on-state and the off-state) to reduce sweating or condensation in the temperature-controller display temperature-controlled display device 10.

The PID controller 810 may receive the setpoint temperature $T_{SP}$ and use the setpoint temperature $T_{SP}$ in the PID control as the setpoint value. The door frame temperature $T_{DF}$ can be received from the door frame temperature sensor 164 as feedback. The PID controller 810 may output a percentage to the control signal generator 814 (e.g., an on-percentage) indicating what percentage of time the heater(s) 162 should be in the on-state. The control signal generator 814 can receive the percentage from the PID controller 810 as the control decision and may generate a duty cycle using the percentage. For example, the control signal generator 814 may output a duty cycle signal to the heater(s) 162 of 100% indicating that the heater(s) 162 should be in the on-state 100% of the time. In another example, the control signal generator 814 generates and output a duty cycle signal to the heater(s) 162 of 50% indicating that the heater(s) 162 should be in the on-state 50% of the time and in the off-state 50% of the time. Likewise, the control signal generator 814 may output a duty cycle signal to the heater(s) 162 of 40% so that the heater(s) 162 are in the on-state for 40% of the time and in the off-state for 60% of the time.

The PID controller 810 can calculate the dewpoint temperature $T_{DP}$ similar to the hysteresis controller 808 as described in greater detail above. For example, the PID controller 810 may calculate the dewpoint temperature $T_{DP}$ using the equation:

$$T_{DP} = \left(\frac{RH}{100}\right)^{\frac{1}{8}}(112 + 0.9T_{amb}) + 0.1T_{amb} - 112$$

where RH is the relative humidity received from the humidity sensor 168, $T_{amb}$ is the ambient temperature received from the ambient temperature sensor 166, and $T_{DP}$ is the calculated dewpoint temperature.

The PID controller 810 can receive or calculate the setpoint temperature $T_{SP}$ using the dewpoint temperature $T_{DP}$. For example, the dewpoint temperature $T_{DP}$ may be re-calculated periodically using new or updated values of the relative humidity RH and the ambient temperature $T_{amb}$. In some embodiments, the setpoint temperature $T_{SP}$ is a temperature value that is a certain amount above the dewpoint temperature $T_{DP}$. For example, the setpoint temperature $T_{SP}$ can be a certain amount $\Delta T$ above the dewpoint temperature $T_{DP}$. In this way, the setpoint temperature $T_{SP}$ may be dynamically calculated or updated using the equation:

$$T_{SP}=T_{DP}+\Delta T$$

where $T_{DP}$ is the dewpoint temperature, and $\Delta T$ is the amount that the setpoint temperature $T_{SP}$ is above the dewpoint temperature $T_{DP}$. The PID controller 810 may update or re-calculate the temperature setpoint $T_{SP}$ whenever the dewpoint temperature $T_{DP}$ is re-calculated (e.g., based on newly received values of the ambient temperature $T_{amb}$ and/or based on newly received values of the relative humidity RH). In some embodiments, the amount $\Delta T$ is a temperature amount such as 5 degrees Fahrenheit, 3 degrees Fahrenheit, etc.

The PID controller 810 can use the temperature setpoint $T_{SP}$ and can generate percentage values (e.g., for the control signal generator 814) that maintain the door frame temperature $T_{DF}$ at or above the temperature setpoint $T_{SP}$. In this way, the door frame temperature $T_{DF}$ can be maintained above the dewpoint temperature $T_{DP}$ to thereby facilitate reducing sweating and/or moisture condensation. In some embodiments, the duty cycle signal is generated by the control signal generator 814 using the percent received from the PID controller 810. The control signal generator 814 may also generate the duty cycle signals in post-processing using a lookup table or linearly.

In other embodiments, the control signal generator 814 is configured to vary or change voltage that is applied to the heater(s) 162 (e.g., based on the control decisions provided by the PID controller 810 or the hysteresis controller 808). For example, the control signal generator 814 may increase or decrease the voltage that is provided to the heater(s) 162 based on the control decisions generated by the hysteresis controller or the PID controller 810.

Dewpoint and Door Frame Temperature Graph

Figure 7:
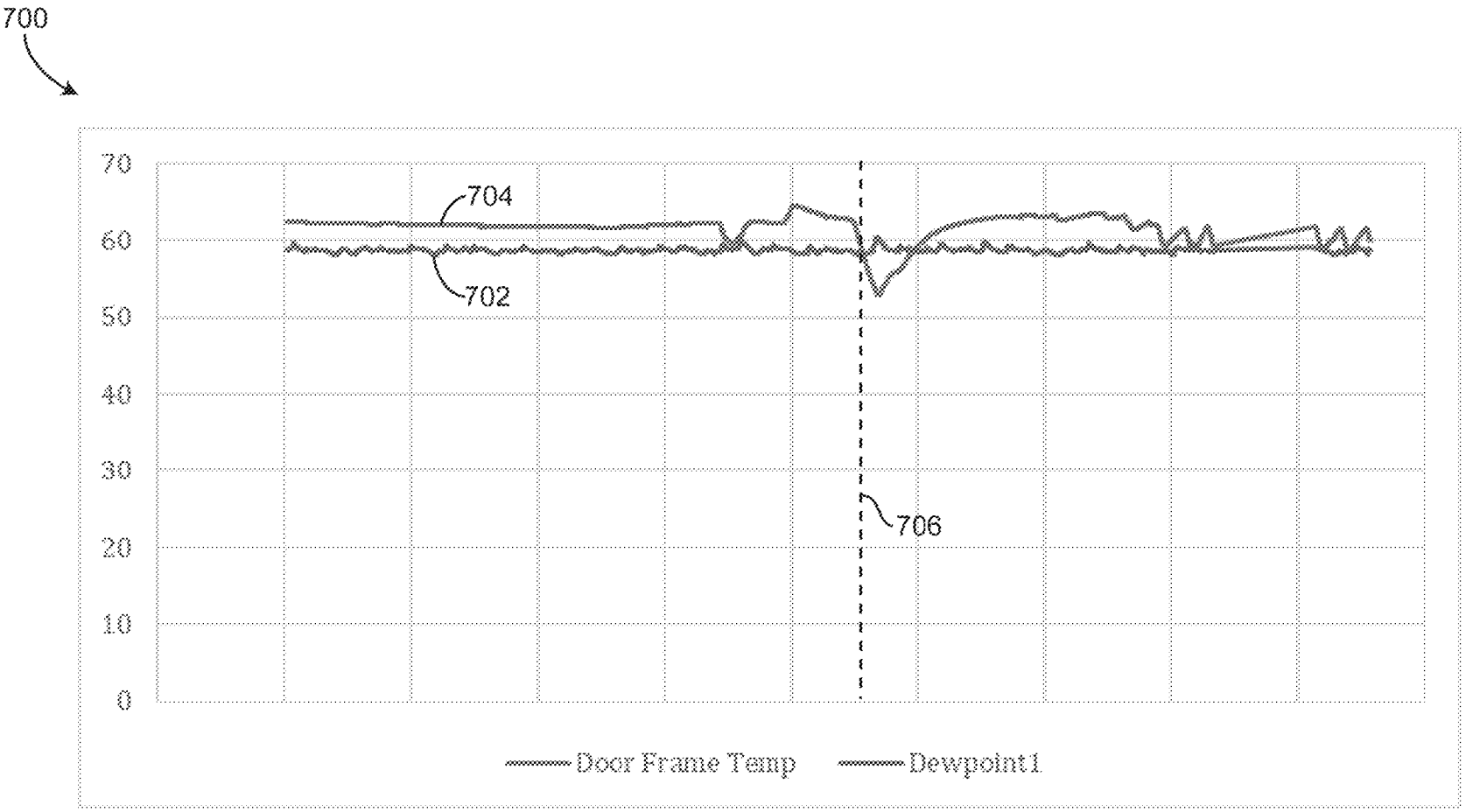
FIG. 7 is a graph of dewpoint and door frame temperature over time, according to an exemplary embodiment.

Referring particularly to FIG. 7, a graph 700 shows door frame temperature $T_{DF}$ and dewpoint temperature $T_{DP}$ with respect to time, according to some embodiments. The graph 700 includes a series 702 and a series 704. The series 702 shows the dewpoint temperature $T_{DP}$ with respect to time (the X-axis). The series 704 shows the door frame temperature $T_{DF}$ with respect to time. As shown in graph 700, the dewpoint temperature $T_{DP}$ remains relatively constant over time. Additionally, the door frame temperature $T_{DF}$ is maintained above the dewpoint temperature $T_{DP}$ to reduce sweating and/or condensation within the temperature-controlled display device 10. At time 706, the door frame temperature $T_{DF}$ drops below the dewpoint temperature $T_{DP}$. After time 706, the heater(s) 162 are operated to drive the door frame temperature $T_{DF}$ above the dewpoint temperature $T_{DP}$ to reduce condensation within the temperature-controller display device 10.

Hysteresis Control Process

Figure 9:
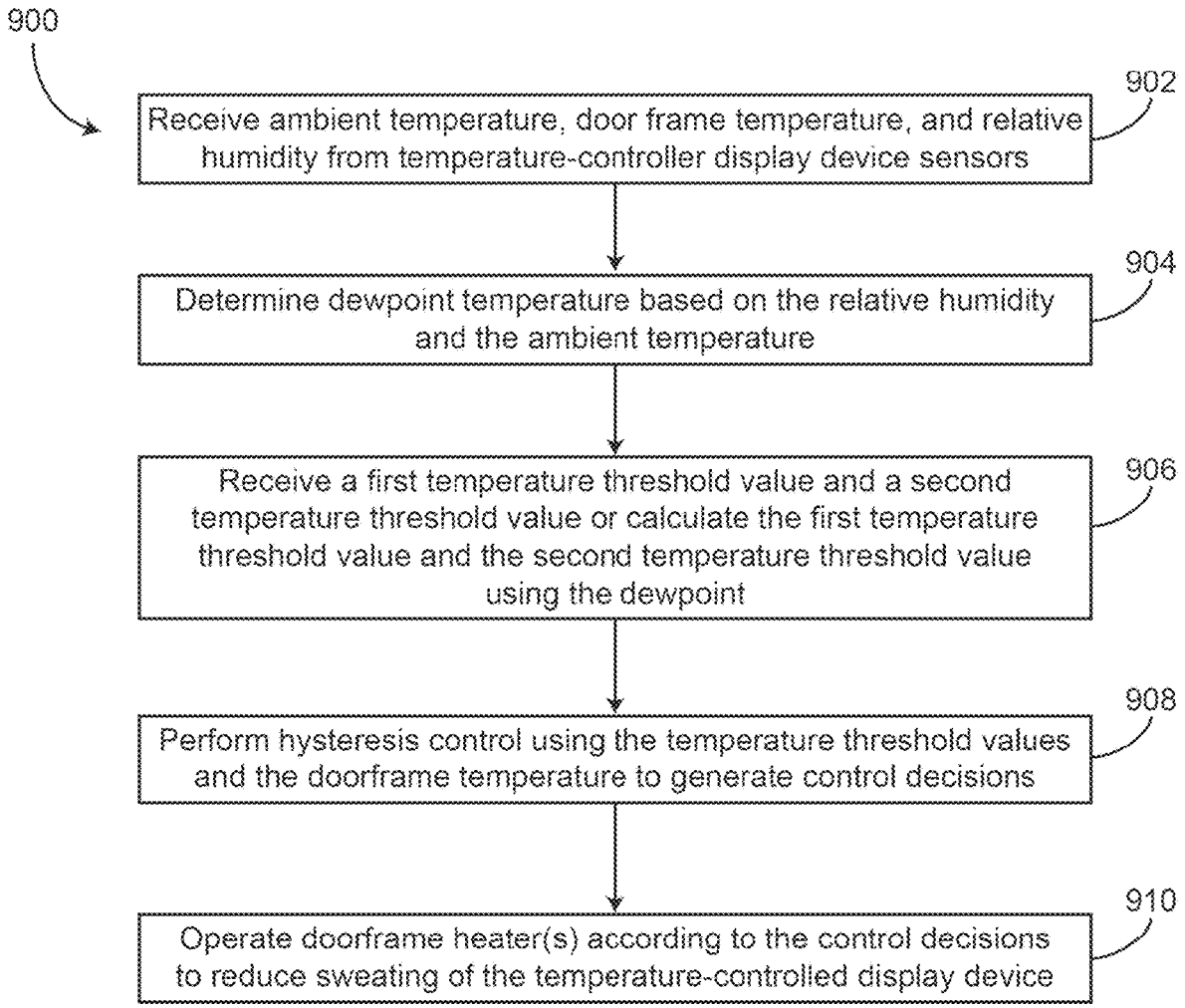
FIG. 9 is a process for operating a temperature-controlled display device to reduce condensation using hysteresis control, according to an exemplary embodiment.

Referring particularly to FIG. 9, a process 900 for operating a temperature-controlled display device (e.g., a display case) with hysteresis control is shown, according to some embodiments. The process 900 includes steps 902-910 and can be performed to reduce sweating within the temperature-controlled display device 10. The temperature-controlled display device may include a controller, a variety of temperature and/or humidity sensors, a heating element, and/or a cooling element configured to perform process 900 to reduce sweating or condensation of moisture within the temperature-controlled display device.

Process 900 includes receiving values of ambient temperature, door frame temperature, and relative humidity from the temperature-controlled display device (e.g., from sensors of the temperature-controlled display device, step 902), according to some embodiments. The step 902 can be performed by the controller 502. For example, the ambient temperature $T_{amb}$ values can be received from the ambient temperature sensor 166, the door frame temperature $T_{DF}$ values can be received from the door frame temperature sensor 164, and the relative humidity RH values can be received from the humidity sensor 168. These values may be received periodically (e.g., every 1 second, every 0.5 seconds, etc.), according to a schedule, or may be received by the controller 500 in response to the controller 500 reading the values of the ambient temperature sensor 166, the door frame temperature sensor 164, and/or the humidity sensor 168.

Process 900 includes determining a dewpoint temperature $T_{DP}$ based on the relative humidity RH and the ambient temperature $T_{amb}$ (step 904), according to some embodiments. In some embodiments, step 904 is performed by the hysteresis controller 808. The hysteresis controller 808 may calculate the dewpoint temperature $T_{DP}$ using the equation shown above and the dewpoint temperature $T_{DP}$ and the relative humidity RH.

Process 900 includes receiving a first temperature threshold value and a second temperature threshold value or calculating the threshold values using the dewpoint temperature $T_{DP}$ (step 906), according to some embodiments. In some embodiments, the first and second temperature threshold values are received by the controller 500 from the user interface 504. In other embodiments, the first and second temperature threshold values are pre-programmed values that are stored in and used by the controller 500. In still other embodiments, the first and second temperature threshold values are calculated by the hysteresis controller 808 using the dewpoint temperature $T_{DP}$ and corresponding temperature quantities (e.g., $\Delta T_1$ and $\Delta T_2$). For example, the first temperature threshold value $T_1$ can be determined using the equation:

$$T_1=T_{DP}+\Delta T_1$$

where $T_{DP}$ is the dewpoint temperature $T_{DP}$, and $\Delta T_1$ is a first temperature quantity (e.g., 2 or 5 degrees Fahrenheit). The second temperature threshold value $T_2$ can be determined using the equation:

$$T_2=T_{DP}+\Delta T_2$$

where $T_{DP}$ is the dewpoint temperature, and $\Delta T_2$ is a second temperature quantity (e.g., 2 or 5 degrees Fahrenheit).

Process 900 includes performing hysteresis control using the temperature threshold values (e.g., $T_1$ and $T_2$) and the door frame temperature $T_{DF}$ to generate control decisions (step 908), according to some embodiments. In some embodiments, step 908 is performed by the hysteresis controller 808. The hysteresis controller 808 can generate control decisions using the door frame temperature $T_{DF}$ as feedback from the temperature-controlled display device 10, and the temperature threshold values $T_1$ and $T_2$ as trigger or threshold values. For example, the hysteresis controller 808 can determine that the heater(s) 162 should be transitioned between an on-state (e.g., a heating state) and an off-state (e.g., an inactive or standby state) based on whether the door frame temperature $T_{DF}$ exceeds or drops below the temperature threshold values $T_1$ and $T_2$.

Process 900 includes operating the door frame heater(s) according to the control decisions to reduce sweating of the temperature-controlled display device (step 910), according to some embodiments. In some embodiments, step 910 is performed by the control signal generator 814 based on the control decisions determined by the hysteresis controller 808. For example, the control signal generator 814 can generate control signals to transition the heater(s) 162 between the on-state and the off-state according to the control decisions determined by the hysteresis controller 808.

PID Control Process

Figure 10:
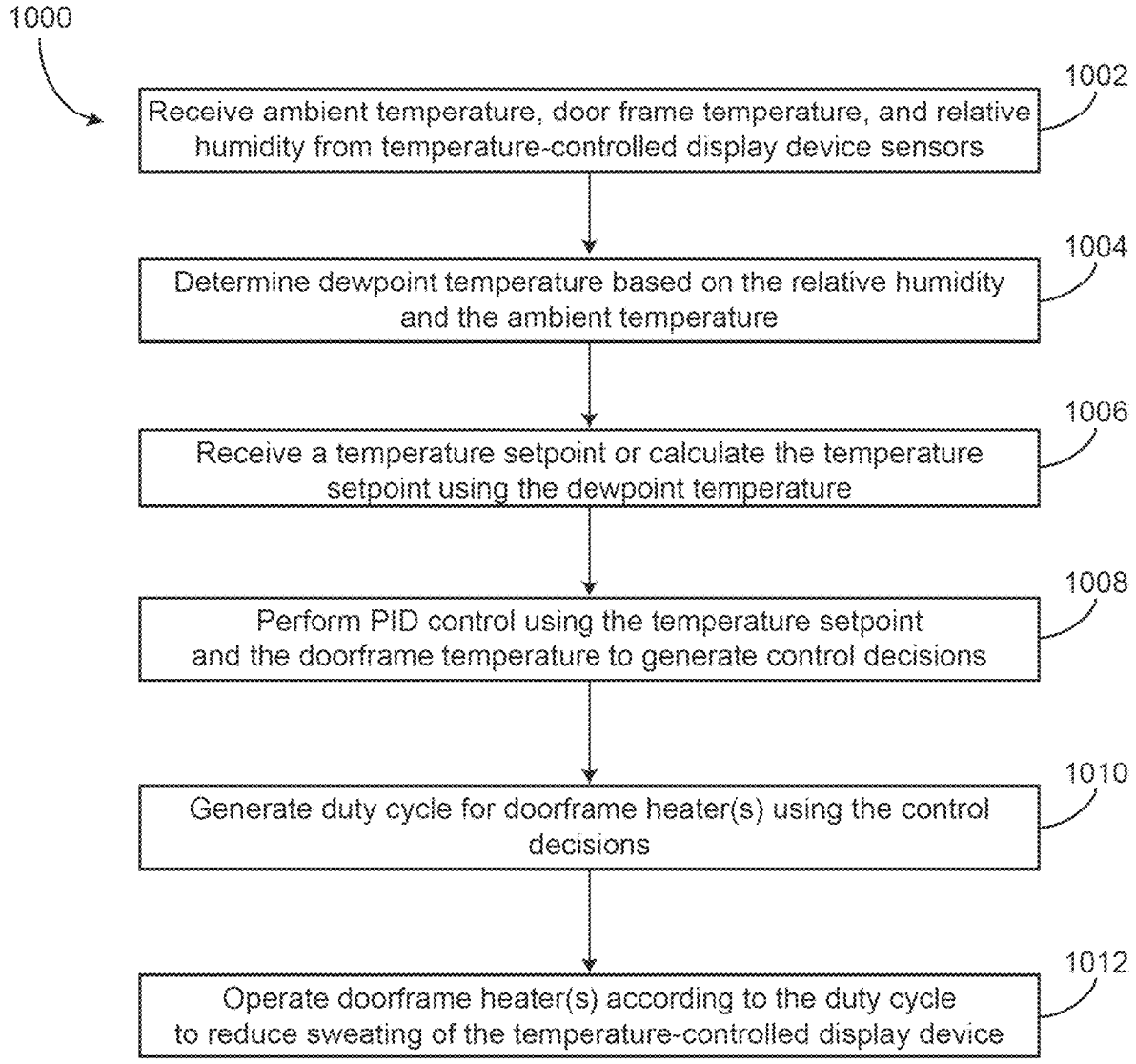
FIG. 10 is a process for operating a temperature-controlled display device to reduce condensation using proportional-integral-derivative (PID) control, according to an exemplary embodiment.

Referring particularly to FIG. 10, a process 1000 for operating a temperature-controlled display device (e.g., a display case) with PID control is shown, according to some embodiments. The process 1000 includes steps 1002-1012, according to some embodiments. The process 1000 can be performed by the controller 500, the sensors 164-168, and the heater(s) 162. The process 1000 can be performed using PID control to maintain the temperature within the temperature-controlled display device above a dewpoint temperature to reduce sweating or condensation in the temperature-controlled display device.

Process 1000 includes receiving values of ambient temperature, door frame temperature, and relative humidity from the temperature-controlled display device (step 1002), according to some embodiments. The step 1002 can include receiving value(s) of the ambient temperature $T_{amb}$ from the ambient temperature sensor 166, the door frame temperature $T_{DF}$ from the door frame temperature sensor 164, and the relative humidity RH from the humidity sensor 168. The step 1002 can be the same as or similar to the step 902 of the process 900.

Process 1000 includes determining a dewpoint temperature $T_{DP}$ based on the relative humidity RH and the ambient temperature $T_{amb}$ (step 1004), according to some embodiments. The dewpoint temperature $T_{DP}$ can be calculated or estimated using the ambient temperature $T_{amb}$ and the relative humidity RH received from the ambient temperature sensor 166 and the humidity sensor 168, respectively. The step 1004 can be performed by the PID controller 810. The step 1004 can be the same as or similar to the step 904 of the process 900.

Process 1000 includes receiving a temperature setpoint $T_{SP}$ or calculating the temperature setpoint using the dewpoint temperature $T_{DP}$ (step 1006), according to some embodiments. The step 1006 can be performed by the PID controller 810 of the controller 500. The step 1006 can include calculating the temperature setpoint $T_{SP}$ as a temperature value that is above the dewpoint temperature $T_{DP}$ by some amount (e.g., $\Delta T$).

Process 1000 includes performing PID control using the temperature setpoint $T_{SP}$ and the door frame temperature $T_{DF}$ to generate control decisions (step 1008), according to some embodiments. The step 1008 can be performed by the PID controller 810. The step 1008 may include performing PID control to generate control decisions (e.g., a percentage value for on-time of the heater(s) 162) that maintain the door frame temperature $T_{DF}$ above or at the setpoint temperature $T_{SP}$ (i.e., above the dewpoint temperature $T_{DP}$).

Process 1000 includes generating a duty cycle signal for the door frame heater(s) (e.g., heater(s) 162) using the control decisions as generated in step 1008 (step 1010), according to some embodiments. The duty cycle signal can be generated by the control signal generator 814 using the control decisions as determined by the PID controller 810 (e.g., the percent of on-time). The duty cycle signal is provided to the heater(s) 162 to operate the heater(s) 162 to maintain the door frame temperature $T_{DF}$ at or above the temperature setpoint $T_{SP}$.

Process 1000 includes operating the door frame heater(s) (e.g., heater(s) 162) according to the duty cycle signal to reduce sweating of the temperature-controlled display device (e.g., the temperature-controlled display device 10)

(step 1012), according to some embodiments. The step 1012 can be performed by the heater(s) 162 and the control signal generator 814. Advantageously, the process 1000 can be performed by the controller 500 to maintain the temperature within the temperature-controlled display device 10 or the door frame temperature $T_{DF}$ above the dewpoint temperature $T_{DP}$, thereby reducing sweating in the temperature-controlled display device 10.

Configuration of Exemplary Embodiments

The construction and arrangement of the temperature-controlled display device as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the terms "exemplary" and "example" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent, etc.) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "first", "second", "primary," "secondary," "above," "below," "between," etc.) are merely used to describe the orientation of various elements in the FIGURES. It should be noted that the orientation of various elements may differ according to other exemplary embodiments, and that such variations are intended to be encompassed by the present disclosure.

The present disclosure contemplates methods, systems and program products on memory or other machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products or memory including machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the FIGURES may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. An apparatus, comprising:

a housing comprising a door frame;

a door frame heater configured to provide heating to the door frame;

a door frame temperature sensor configured to measure a door frame temperature;

a humidity sensor configured to measure a relative humidity of an environment that surrounds at least a portion of the housing;

an ambient temperature sensor configured to measure an ambient temperature of the environment that surrounds at least the portion of the housing; and a controller comprising processing circuitry configured to perform operations comprising:

identifying at least one value of the door frame temperature, at least one value of the relative humidity of the environment, and at least one value of the ambient temperature of the environment;

calculating a value of a dewpoint temperature using the least one value of the door frame temperature, at least one value of the relative humidity of the environment, and at least one value of the ambient temperature of the environment;

comparing the value of the dewpoint temperature to the value of the temperature at the door frame;

based on the comparison of the value of the dewpoint temperature and the value of the door frame temperature, generating a control decision for the door frame heater; and operating the door frame heater based on the control decision to maintain the value of the door frame temperature at or above the value of the dewpoint temperature.

2. The apparatus of claim 1, wherein the processing circuitry is further configured to perform operations comprising:

determining a first temperature threshold value by adding a first quantity to the value of the dewpoint temperature; and determining a second temperature threshold value by adding a second quantity to the value of the dewpoint temperature.

3. The apparatus of claim 2, wherein the controller is further configured to perform operations comprising:

comparing the value of the dewpoint temperature, the value of the temperature at the door frame, the first temperature threshold value, the second temperature threshold value; and based on the comparison between the value of the dewpoint temperature, the value of the door frame temperature, the first temperature threshold value, and the second temperature threshold value, generating a control decision for the door frame heater.

4. The apparatus of claim 2, wherein the first quantity is less than the second quantity.

5. The apparatus of claim 2, wherein the first temperature threshold value and the second temperature threshold value are greater than the value of the dewpoint temperature.

6. The apparatus of claim 5, wherein the processing circuitry is configured to transition the door frame heater between an on-state or a heating state, and an off-state or a standby state in response to the value of the door frame temperature exceeding one of the first temperature threshold value and the second temperature threshold value.

7. The apparatus of claim 5, wherein the processing circuitry is configured to operate the door frame heater to maintain the value of the door frame temperature at or above the value of the dewpoint temperature to reduce sweating in the housing.

8. The apparatus of claim 1, wherein the ambient temperature sensor is positioned on the door frame.

9. The apparatus of claim 1, wherein the ambient temperature sensor is positioned on a door coupled to the door frame.

10. The apparatus of claim 1, wherein the door frame temperature sensor is configured to measure or obtain the value of the door frame temperature at a coldest location of the door frame.

11. The apparatus of claim 2, wherein the processing circuitry of the controller comprises a hysteresis controller configured to perform operations comprising:

calculating the value of a dewpoint temperature ($T_{DP}$) using the values of the relative humidity of the environment (RH), and the ambient temperature of the environment ($T_{amb}$);

determining the first temperature threshold value by adding the first quantity to the value of the dewpoint temperature;

determining the second temperature threshold value by adding the second quantity to the value of the dewpoint temperature;

comparing the value of the dewpoint temperature to the value of the door frame temperature, the first temperature threshold value, and the second temperature threshold value; and based on the comparison, generating a control signal to transition the door frame heater to an on-state when the value of the door frame temperature decreases below the first temperature threshold value and transition the door frame heater to an off-state when the value of the door frame temperature increases above the second temperature threshold value.

12. The apparatus of claim 11, wherein calculating the value of a dewpoint temperature ($T_{DP}$) using the values of the relative humidity of the environment (RH), and the ambient temperature of the environment ($T_{amb}$) comprises:

calculating $$T_{DP} = \left(\frac{RH}{100}\right)^{\frac{1}{8}}(112 + 0.9T_{amb}) + 0.1T_{amb} - 112.$$

13. The apparatus of claim 11, wherein the hysteresis controller is further configured to perform operations comprising generating a control decision, based on the comparison, to maintain the door frame heater in the on-state when the value of the door frame temperature is between the first temperature threshold and the second temperature threshold.

14. The apparatus of claim 11, wherein the hysteresis controller is further configured to perform operations comprising generating the control decision, based on the comparison, to maintain the door frame heater in the off-state until the value of the door frame temperature drops below the first temperature threshold.

15. The apparatus of claim 11, wherein the control decision generated by the hysteresis controller operates a control signal generator configured to increase a voltage applied to the door frame heater.

16. The apparatus of claim 11, wherein the control decision generated by the hysteresis controller operates a control signal generator configured to decrease a voltage applied to the door frame heater.

17. The apparatus of claim 2, wherein the processing circuitry of the controller comprises a PID controller configured to perform operations comprising:

receiving values of the door frame temperature, the relative humidity of the environment, and the ambient temperature of the environment;

calculating the value of a dewpoint temperature ($T_{DP}$) using the values of the relative humidity of the environment (RH), and the ambient temperature of the environment ($T_{amb}$);

performing PID control to generate a control decision using a value of a setpoint temperature and the value of the door frame temperature;

comparing the value of the dewpoint temperature to the value of the temperature at the door frame and the value of the setpoint temperature; and based on the comparison, operating the door frame heater to maintain the value of the door frame temperature at or above the value of the setpoint temperature.

18. The apparatus of claim 16, wherein calculating the value of a dewpoint temperature ($T_{DP}$) using the values of the relative humidity of the environment (RH), and the ambient temperature of the environment ($T_{amb}$) comprises:

calculating $$T_{DP} = \left(\frac{RH}{100}\right)^{\frac{1}{8}}(112 + 0.9T_{amb}) + 0.1T_{amb} - 112.$$

19. The apparatus of claim 17, wherein the controller is further configured to perform operations comprising:

adding a predetermined temperature quantity to the value of the dewpoint temperature; and adjusting the setpoint temperature in response to changes in the value of the door frame temperature or changes in the value of the relative humidity of the environment.

20. The apparatus of claim 17, wherein the controller further comprises a control signal generator configured to perform operations comprising:

receiving the control decision from the PID controller; and generating a control signal to operate the door frame heater.

21. The apparatus of claim 20, wherein the control signal generator is configured to perform operations comprising:

determining a percent of time that the door frame heater should be in an on-state to maintain the value of the door frame temperature at or above the value of the setpoint temperature;

based on the percent of time that the door frame heater should be in an on-state to maintain the value of the door frame temperature at or above the value of the setpoint temperature, generating a duty cycle signal; and providing the duty cycle signal to the door frame heater to maintain the value of the door frame temperature at or above the value of the dewpoint temperature.

22. The apparatus of claim 19, wherein the control signal generator is configured to perform operations comprising:

retrieving a duty cycle value from at least one of a lookup table or a linear graph;

based on the duty cycle value, generating a duty cycle signal; and providing the duty cycle signal to the door frame heater to maintain the value of the door frame temperature at or above the value of the dewpoint temperature.

23. The apparatus of claim 19, wherein the control signal generator is configured to perform operations comprising increasing a voltage applied to the door frame heater.

24. The apparatus of claim 19, wherein the control signal generator is configured to perform operations comprising decreasing a voltage applied to the door frame heater.

* * * * *